US006408724B1

(12) United States Patent
Whiteford

(10) Patent No.: US 6,408,724 B1
(45) **Date of Patent: *Jun. 25, 2002**

(54) SELF-ADJUSTING PLIER-TYPE LOCKING TOOL

(75) Inventor: Carlton L. Whiteford, Westport, CT (US)

(73) Assignee: Adjustable Clamp Company, Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/618,263

(22) Filed: Mar. 18, 1996

(51) Int. Cl.[7] ..... B25B 7/12
(52) U.S. Cl. ..... 81/367; 81/370
(58) Field of Search ..... 81/367–384

(56) References Cited

U.S. PATENT DOCUMENTS

| | | | | |
|---|---|---|---|---|
| 2,531,285 A | | 11/1950 | Manspeaker | 81/84 |
| 2,618,188 A | * | 11/1952 | Emmett | 81/372 X |
| 2,853,910 A | | 9/1958 | Petersen | 81/368 |
| 3,104,571 A | | 9/1963 | Trybus | 81/380 |
| 3,116,656 A | | 1/1964 | Hostetter | 81/379 |
| RE26,280 E | | 10/1967 | Hostetter | 81/379 |
| 3,354,759 A | | 11/1967 | Cook | 81/379 |
| 3,600,986 A | | 8/1971 | Baldwin, Jr. | 81/370 |
| 3,709,073 A | | 1/1973 | Kurtz | 81/119 |
| 4,094,215 A | | 6/1978 | Hudson | 81/127 |
| 4,297,756 A | | 11/1981 | Lance | 7/125 |
| 4,407,493 A | | 10/1983 | Okolischan | 269/93 |
| 4,499,797 A | | 2/1985 | Wilson | 81/367 |
| 4,541,312 A | | 9/1985 | Petersen | 81/367 |
| 4,546,680 A | | 10/1985 | Petersen | 81/367 |
| 4,662,252 A | | 5/1987 | Warheit | 81/341 |
| 4,707,924 A | | 11/1987 | Burney | 30/363 |
| 4,709,601 A | | 12/1987 | Petersen | 81/367 |
| 4,724,729 A | | 2/1988 | Oetiker | 81/9.3 |
| 4,730,524 A | | 3/1988 | Petersen | 81/367 |
| 4,754,668 A | | 7/1988 | Oetiker | 81/9.3 |
| 4,802,390 A | | 2/1989 | Warheit | 81/341 |
| 4,850,254 A | | 7/1989 | Burney | 81/367 |
| 5,271,300 A | | 12/1993 | Zurbuchen et al. | 81/124.4 |
| 5,351,584 A | | 10/1994 | Warheit | 81/407 |
| 5,435,214 A | | 7/1995 | Sisson | 81/376 |
| 5,448,932 A | | 9/1995 | Zurbuchen et al. | 81/124.4 |
| 5,469,765 A | | 11/1995 | Franklin | 81/324 |

* cited by examiner

*Primary Examiner*—D. S. Meislin
(74) *Attorney, Agent, or Firm*—Cook, Alex, McFarron, Manzo, Cumming & Mehler, Ltd.

(57) ABSTRACT

An adjustable locking pliers-type tool has a first handle provided with a fixed jaw, a movable jaw pivotally connected to the first handle, a second handle pivotally connected to the movable jaw, and a toggle linkage system cooperatively connected between the two handles. The linkage system includes a toggle link connected to one of a pair of wedges disposed in the first handle and coacts through a shoulder thereon with the second wedge. The two wedges are magnetically attracted into close contact with a floater plate separating the wedges with a force sufficient to prevent formation of oil films between their mating surfaces.

16 Claims, 3 Drawing Sheets

LOW 15
15

SELF-ADJUSTING PLIER-TYPE LOCKING TOOL

BACKGROUND OF THE INVENTION

1. Field of the Invention

This invention relates generally to plier-type tools and, more particularly, to a tool of this type which includes a pair of coacting wedges for automatically adjusting the tool proportionally to the size of a work piece engaged by its jaws whereby a thick or thin work piece can be consecutively engaged by the tool without the necessity of adjusting it for the size of the work piece.

2. Description of the Prior Art

This invention is an improvement of the self-adjusting locking tool described in U.S. Pat. No. 3,600,986, titled Self-Adjusting Locking Wrench, issued to Earl M. Baldwin, Jr., on Aug. 24, 1971, which, in turn, describes an improvement of the wrench described in U.S. Pat. No. Re 26,280, titled Self-Adjusting Plier-Type Toggle Locking Wrench, reissued to John L. Hostetter on Oct. 17, 1967. The Hostetter and Baldwin wrenches both utilize an elongated handle having a stationary jaw secured to the forward end, and a movable handle having a triangularly-shaped jaw pivotally connected to its forward end and partially received in a recess defined by the body portion of the first handle. A toggle link is pivotally connected at one end to the movable handle, with the other end extending rearwardly and into the recess in the stationary handle and pivotally connected to the forward end of a first of a pair of coacting wedges slidably disposed within the stationary handle. The forward end of the second wedge is connected by a spring to the rearward side of the movable jaw which exerts a constant forward pull on the second wedge. The inclined surfaces of the wedges are separated by a plate which is prevented from forward or rearward movement by integral laterally extending lugs which engage apertures formed in the side walls of the handle.

In operation, when the movable handle is moved toward the stationary handle, the toggle link moves the first wedge rearwardly to an extent proportional to the size of a work piece engaged between the jaws until the wedges jam against the separation or floater plate and against the surfaces of the recess in the stationary handle and are stopped from further movement.

While the Baldwin tool enjoyed acclaim by the trade and briefly found an important niche in the market, it disappeared and has been missing for many years, reportedly because of manufacturing difficulties. A complaint voiced by auto mechanics while the tool was available was that if accidentally dropped in oil the wedge system would sometimes fail, resulting in unwanted release of the tool from the work piece clamped between the jaws. The failure is believed to have been due to formation of a slippery film of oil between the wedge surfaces and the surfaces of the floater plate which reduced the friction between these relatively slidable elements to a degree that even if the wedges are jammed against the floater plate and the surfaces of the recess in the stationary handle, the clamping force on the work piece transferred through the toggle link to the locking unit would cause one or both of the wedges to move enough to release them.

Accordingly, there exists a need for, and it is a primary object of this invention to provide, a self-adjusting plier-type locking tool having an interconnectable self-adjusting and locking wedge system which is not prone to failure if accidently immersed in oil.

Another object is to provide a self-adjusting tool having a pressure adjustment screw disposed to be easily accessible and which can be provided at minimal expense.

SUMMARY OF THE INVENTION

The self-adjusting locking tool of this invention has a pair of plier-like handles, the first of which has a stationary jaw, and the second of which has a movable jaw pivotally connected thereto and also to the first handle, and a toggle link pivotally connected at one end to the movable handle and pivotally connected at the other end to a first of a pair of coacting wedges slidably disposed within an enclosure in the stationary handle. The forward end of the second wedge is urged forwardly by a compression spring which surrounds a shaft which threadably engages the wedge and is disposed between the rear end of the wedge and the rear wall of the enclosure. The forward end of this shaft projects from the forward end of the wedge into engagement with a rearwardly facing shoulder formed on the toggle link.

The floating wedge is separated from the hinged wedge by a floater plate having parallel planar upper and lower surfaces, and means are provided for magnetically attracting the wedges into such close adjacency with the floater plate as to wipe away any oil that may be present and thus prevent slippery film formation therebetween, while still allowing the wedges and floater plate to slide relative to one another.

BRIEF DESCRIPTION OF THE DRAWINGS

Other objects, features and advantages of the invention will become apparent, and its construction and operation better understood, from the following detailed description when read in conjunction with the accompanying drawings, in which.

DETAILED DESCRIPTION OF THE PREFERRED EMBODIMENT

Figures 1, 2, 3, 5, 8:
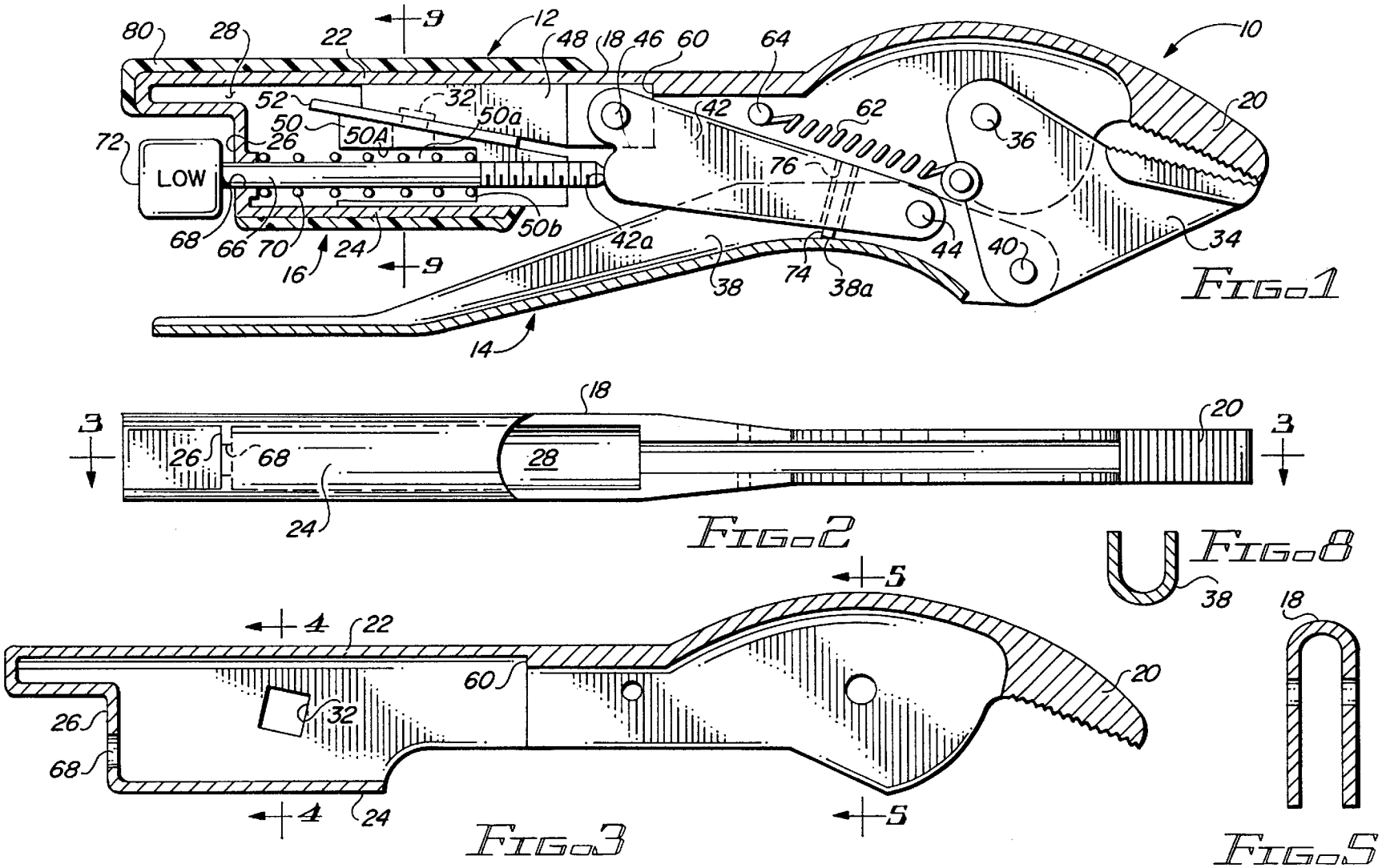
FIG. 1 is a side elevation view, partly in section, of a first embodiment of the tool of this invention.
FIG. 2 is a plan view of the upper handle of the tool as viewed from below in FIG. 1.
FIG. 3 is a sectional view taken along the line 3—3 in FIG. 2.
FIG. 5 is a sectional view taken along the line 5—5 in FIG. 3.
FIG. 8 is a sectional view taken along the line 8—8 in FIG. 7.
Figure 4:
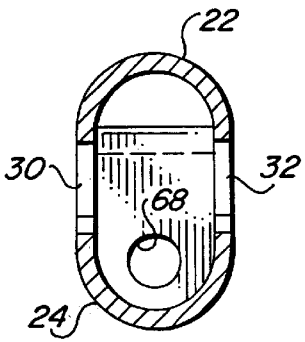
FIG. 4 is a sectional view taken along the line 4—4 in FIG. 3.
Figure 9:
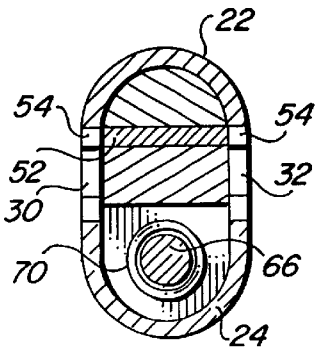
FIG. 9 is a sectional view taken along the line 9—9 in FIG. 1.
Figure 6:
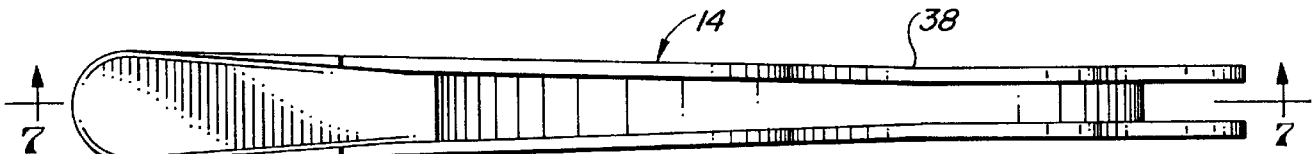
FIG. 6 is a plan view of the movable handle of the tool as viewed from above in FIG. 1.
Figure 7:
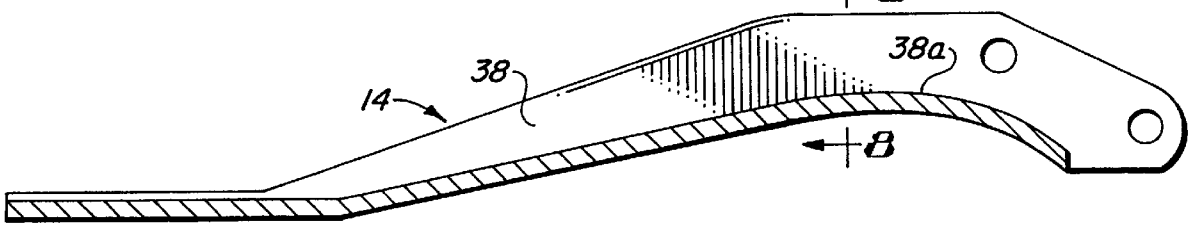
FIG. 7 is a sectional view taken along the line 7—7 in FIG. 6.
Figure 11:
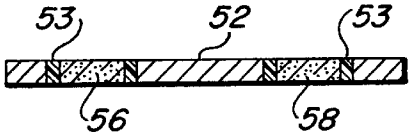
FIG. 11 is a sectional view taken along the line 11—11 in FIG. 10.
Figure 10:
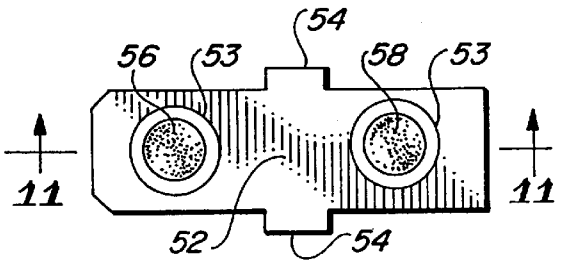
FIG. 10 is a plan view of the floater plate separating the wedges.

Referring to FIGS. 1–11 of the drawings, a first embodiment of the self-adjusting tool 10 of this invention comprises a first handle unit 12, a second handle unit 14, and a self-adjusting locking unit 16 interconnected between the handle units 12 and 14.

The first handle unit 12 includes an elongated handle 18 having a U-shaped body portion which forms an elongated enclosure, and a stationary jaw 20 secured to the forward end of handle 18. Stationary jaw 20 in this embodiment has a curved outer edge. If desired, the outer edge of jaw 20 can be otherwise configured (e.g. squared) to provide additional strength, manufacturing economy or other functional advantages. The rear portion of handle 18 has an inverted U-shaped upper wall 22, a U-shaped lower wall 24, and parallel side walls, which together form a housing 28 that is closed at the rearward end thereof by an integral end wall 26. A portion of end wall 26 is disposed forwardly of the rearward end of handle 12 and forms a recess for accommodating means (to be described) for adjusting the locking pressure of the self-adjusting locking unit 16. The upper and lower U-shaped surfaces 22 and 24 of housing 28 are parallel to each other and to the longitudinal axis of the handle, and the opposing side walls have aligned apertures 30 and 32 formed therein, the purpose of which is described hereinbelow.

Operatively associated with the first handle unit 12 is a triangularly-shaped movable jaw 34 pivotally connected by a pin 36 to the forward end of handle 18 to be operable for coaction with the stationary jaw. As previously noted with respect to stationary jaw 20, if desired movable jaw 34 can also be otherwise shaped (e.g., squared at its forward end) to provide additional strength, manufacturing economies or other functional advantages. The second handle unit 14, a channel-shaped arm 38 substantially equal in length to handle 12, is pivotally secured at its forward end to movable jaw 34 by a pivot pin 40.

The interconnecting, self-adjusting locking unit 16 comprises a toggle link 42 pivotally secured at one end thereof to arm 38 by a pivot pin 44, with the other end thereof extending rearwardly and into the forward end of the enclosure formed by the side walls of U-shaped handle 18. The rearward end of toggle link 42 is pivotally connected by a pivot pin 46 to the thick end of a first or hinged wedge 48, typically made of hardened tool steel, that has an upper surface conforming in shape to the upper inverted U-shaped surface of housing 28 and is slidably disposed therein. A second or floating wedge 50, also made of hardened tool steel and corresponding in cross-section to and slidably disposed in housing 28, is separated from the hinged wedge by a floater plate 52 having parallel planar and smooth upper and lower surfaces. Projecting laterally from each side of plate 52 are holding tabs 54 which, as will be seen in FIG. 91 are wider than the distance between the inner surfaces of the side walls of housing 28; in assembly, the floater plate is inserted into the housing 28 at an angle and then turned into position with tabs 54 projecting into the apertures 30 and 32 to prevent forward or rearward movement of the plate in housing 28 while permitting it to move vertically.

Without a floater plate separating the wedges, the friction therebetween would normally become too great to overcome when in a locked position, making opening of the jaws difficult, if not impossible, and is therefore required. However, should the wrench be accidentally immersed in oil and a lubricating film formed on the mating surfaces, the friction between the floater plate and the wedges may be reduced to a degree that the locked wrench may open inadvertently, or by application of little force to the second handle, and cause unwanted release from the work piece clamped between the jaws.

This potential problem is avoided by providing a floater plate that includes a magnet which exhibits sufficient magnetic pole strength to attract the wedges and maintain the mating surfaces in sufficiently close adjacency as to prevent the entry of any foreign substances, such as oil, therebetween while, at the same time, permitting the wedges to slide relative to the floater plate. The necessary magnetic attraction may be achieved by a spaced pair of circular magnetic disks 56 and 58 fabricated, for example, by a known powder metallurgy process, from any of the several metallic elements of atomic number 57 through 71 ("rare earth" elements or "lathanides") that exhibit a strong magnetic pole strength, such as neodymium, of the same thickness as floater plate 52, typically 1/16-inch thick tool steel. The disks, typically ¼-inch in diameter, being quite frangible are secured in slightly larger diameter openings formed in plate 52 with a bead 53 of epoxy resin or other suitable adhesive.

A stop or shoulder 60 formed in the upper wall of handle 18 forward of hinged wedge 48 prevents forward movement of the hinged wedge beyond a predetermined position when the wrench is in its open position. A tension spring 62 or other suitable resilient means connected at one end to the movable jaw 34, at a location intermediate the pivot pin 36 and 40 connections, and at the other end to a pin 64 located forwardly of pivot pin 46 so as to lie above and not interfere with the operation of toggle link 42, pulls the jaws open when the handles are released.

The thick end of hinged wedge 48 faces the jaw end of the wrench and the thick end of floating wedge 50 faces away from the jaw end. Floating wedge 50 has a smooth cylindrical bore 50*a* of first diameter extending forwardly from its thick end for approximately half the length of the wedge to a shoulder 50*b* at which the bore diameter is reduced and internally threaded for the rest of the length of the wedge. A shaft 66 extending forwardly through an opening 68 in the rear wall of housing 28, through bore 50*a* and threadably engaging the internally threaded bore, is surrounded by a compression spring 70 disposed between rear wall 26 and shoulder 50*b* which urges the floating wedge forwardly toward the jaw end of the wrench. The forward end of shaft 66 projects forwardly of the thin end of the floating wedge into contact with a rearwardly facing shoulder 42*a* formed on toggle link 42. If desired, the forward end of shaft 66 may terminate rearwardly of the forward end of floating wedge 50, in which case this forward end of floating wedge 50 will be in contact with shoulder 42*a*. Shoulder 42*a* has an arcuate shape and coacts with a cam-like action with the forward end of shaft 66.

The clamping pressure of the jaws may be adjusted by turning the threaded shaft 66 with a knob 72 secured to its rearward end and disposed within the recess 74 formed by the re-entrant end wall 26. The knob 72 may be circular cylindrical in shape, or preferably it has a square cross-section of a size generally corresponding to the thickness of the handle body 28 so as to fit within the recess and give the rearward end of the handle a smooth profile and to be prevented against rotation by the rearward overhang defining the upper edge of the recess. If adjustment of the clamping pressure is desired, knob 72 is pulled rearwardly against the bias of spring 70 a distance corresponding to the axial length of the knob, at which point it may be rotated to adjust the distance the forward end of shaft 66 projects from the thin end of floating wedge 50. Positioning of the floating wedge forwardly by turning knob 72 counterclockwise provides greater clamping pressure as the wedges set sooner in the housing. A lesser clamping pressure is accomplished by turning knob 72 in the opposite direction to move the wedge rearwardly. The thread on shaft 66 is sufficiently coarse that only a quarter turn of the knob is needed to change the clamping pressure from "low" to "medium", for example, and another quarter turn to change from "medium" to "high", whereby the pressure may be visually displayed by marking successive adjacent faces of the knob with the legends LOW, MED and HIGH.

Having described the construction of the tool, its method of operation will now be described. At the start of the closing cycle the forward wall of hinged wedge 48 lies against shoulder 60, the tension spring 62 holds the jaws open to facilitate insertion of a workpiece, and compression spring 70 pushes the floating wedge 50 fully forward against the shoulder 42*a* of toggle link 42 and also holds the hinged wedge against shoulder 60. The wedges are now free for repositioning, the knob 72 having previously been positioned to the desired clamping pressure of the jaws. Upon movement of the second handle 14 from its open position toward the first handle 12, that is, toward a closed position, hinged wedge 48 will be moved rearwardly by toggle link 42 to an extent proportional to the size of a workpiece (not shown) engaged between the jaws, and the shoulder 42*a* on the toggle link will push the floating wedge rearwardly. The floater plate 52 adjusts upwardly automatically as the wedges are moved rearwardly. Rearward movement of the wedges continues until the shoulder 42*a* leaves the end of shaft 66 projecting from the floating wedge because of rotation of the toggle link about pin 46. At this point the spring 70 cannot overcome the friction between the wedges and the floater plate 52 and the floating wedge cannot move forwardly. The floating wedge 50 and plate 52 are in a locked condition and continued closing action of the second handle causes hinged wedge 48 to move rearwardly for a short distance, jamming the wedges in the housing and locking the jaws of the tool.

When the second handle 14 is fully moved into the closed position shown in FIG. 1, the pivot pin 44 is disposed above an imaginary line connecting the pivot pins 40 and 46. To snap over this imaginary line, toggle link 42 is compressed, subjecting pins 40, 44 and 46 to a deflecting force and, in effect, causing the link and the pins to store energy, the amount of which determining the force necessary to open the wrench. The stored energy is limited to an amount that will permit relatively easy opening, yet maintain the jaws in locked position, by limiting the compression of toggle link 42 which, in turn, is accomplished by limiting the distance the link moves beyond the point at which it initially snaps over the imaginary line. This is done by a screw 74 threaded into a threaded opening 76 which extends transversely through toggle link 42 at a location inwardly from pivot pin 44 opposite the highest point 38*a* of the channel 38 of handle unit 14. As the handles are being squeezed together, the protruding end of the screw 74 engaging the bottom of channel 38 determines how closely it can be moved toward the first handle. The extent of protrusion of the screw is adjustable to a length at which the locked tool can be opened with only finger pressure.

The tool is opened by pivotal movement of handle 14 away from handle 12 about pivot pin 40 with sufficient force to cause pivot pin 44 to pass over the imaginary line and allow the other end of toggle link 42 to pivot about pin 46. The shoulder 42*a* on the link contacts floating wedge 50 and pushes it rearwardly against the bias of spring 70, while the toggle link pulls hinged wedge 48 forwardly to break the jam between the wedges, the floating plate 52 and the U-shaped upper and lower surfaces of the housing. The moment the imaginary line is passed, the energy stored in the link and pins snap the link to an open position without additional pressure on the second handle.

The body portion of handle 18 preferably is encased in a sleeve 80, which may be formed of a suitable plastic, to enhance the appearance of the wrench and make it more comfortable to use.

FIGS. 12–16 show another presently preferred embodiment of the tool of the invention which, like the first embodiment, comprises a first handle unit 112, a second handle unit 114, and a self-adjusting locking unit 116 interconnected between the handle units 112 and 114.

Figures 12, 13, 14, 15, 16:
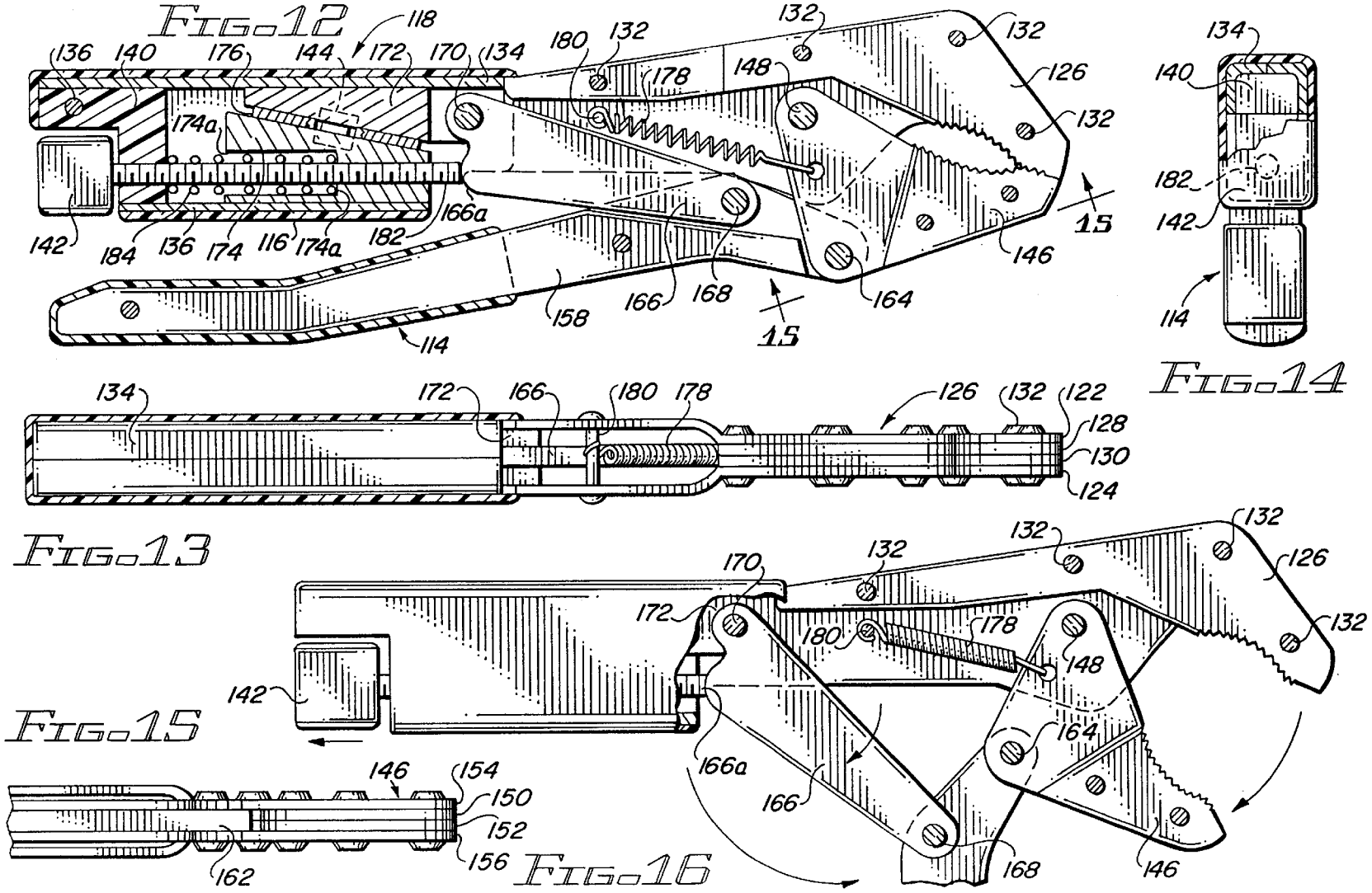
FIG. 12 is a side elevation view,partly in section, of a second embodiment of the tool of this invention.
FIG. 13 is a top view of the tool.
FIG. 14 is a left end view of the tool.
FIG. 15 is a view taken along the line 15—15 of FIG. 12.
FIG. 16 is a side elevation view, partly broken away, of the tool in an open position.

The handle unit 112 includes an elongated handle 118 made from sheet steel shaped and bent to form a rectangularly-shaped body portion 120 which defines an elongate enclosure and to form the outer laminae 122 and 124 of a laminated stationary jaw 126 at the forward end of the handle. Two generally L-shaped inner laminae 128 and 130 made of sheet steel are assembled between and pinned to laminae 122 and 124 by rivets or bolts 132 to form a sturdy stationary jaw. The outer edges of the inner laminae, of which lamina 128 is visible in FIG. 12, are coincident with the outer edges of the outer laminae and their interior edges are shaped to define together with the outer laminae a recess for receiving a portion of a movable jaw 146, to be described presently. The outer edge of jaw 126 has a squared configuration defined by interconnected straight lines to provide added strength, economies in manufacture and other advantages. Alternatively, the inner laminae may be made of one or more layers of any suitable durable high strength plastic material having the shape shown in FIG. 12.

The rear portion of handle 118 has parallel opposed upper and lower walls 134 and 136, respectively, and parallel side walls, which together form a housing 138 that is closed at its rearward end by an inverted L-shaped end wall 140. This end wall may be formed from any suitable rigid high strength plastic material and secured within the housing by a transverse rivet or bolt extending through aligned openings provided in the side walls and through the end wall. The inverted L-shape of the end wall forms a recess for accommodating a knob 142 for adjusting the locking pressure of the self-adjusting locking unit 116. The upper and lower walls of housing 138 are parallel to each other and to the longitudinal axis of the handle, and the opposing side walls have aligned apertures, one of which is visible at 144 in FIG. 12, the purpose of which is described below. The body portion of the handle preferably is encased in a suitable pliant plastic material to enhance the appearance of the tool and make it comfortable to use.

Operatively associated with stationary jaw 126 is a triangularly shaped movable jaw 146 partially received in the aforementioned recess at the forward end of handle 118 and pivotally connected thereto by a pin 148 to be operable for coaction with the stationary jaw. The movable jaw is also constructed from laminated flat parts, which include planar inner laminae 150 and 152 preferably made of sheet steel having a combined thickness which allows them to be received in the aforementioned recess between the outer laminae 122 and 124 of the stationary jaw, and two outer triangularly-shaped steel laminae 154 and 156 of smaller area suitably pinned to the inner laminae to form a sturdy movable jaw having the same thickness as the stationary jaw. The movable jaw is also squared at the forward end to provide additional strength and manufacturing economies.

The second handle unit 114 is a laminate composed of elongated rigid planar sheet steel members 158 and 160 and a spacer 162 therebetween which extends from the distal end of the member to a point short of the forward end to provide a channel between the forward ends of members 158 and 160. The spacer 162 preferably is made from a suitable rigid plastic material, but may be made of steel, if desired. The outer laminae and the spacer are suitably pinned to form the rigid handle member 114, the forward end of which is pivotally secured to movable jaw 146 by a pivot pin 164. The handle member is encased in a flexible plastic sleeve to provide a comfortable hand hold for the user.

The construction and operation of the self-adjusting locking unit 116 being substantially the same as that of the locking unit 16 of the first embodiment, in the interest of avoiding unnecessary redundancy it will be only briefly described. The locking unit includes a toggle link 166 pivotally secured at one end to and between the forward ends of planar members 158 and 160 by a pivot pin 168 with the other end thereof extending rearwardly and being pivotally connected by a pivot pin 170 to the forwardly-facing thick end of a first steel wedge 172 having a flat upper surface in sliding contact with the upper wall 134 of housing 138. A floating steel wedge 174 having a thick edge facing away from the jaw end and a flat under surface in sliding contact with the lower wall 136 of the housing is separated from the hinged wedge by a floater plate 176, which may be of the same shape and construction as the floater plate of the first embodiment, including the laterally extending tabs which project into the side wall apertures (e.g., aperture 144) to prevent rearward or forward movement of the plate in housing 138, while permitting the plate to move vertically. Magnetic attraction between the wedges and the floater plate 15 provided by a pair of magnets embedded in the floater plate as described above in connection with FIGS. 10 and 11.

A shoulder formed in the upper wall 134 of the first handle forward of wedge 172 prevents forward movement of the hinged wedge beyond a predetermined position when the tool is open. A tension spring 178 connected between a location on the movable jaw 144 intermediate the pivot pin 148 and 164 connections and a transverse pin 180 extending through handle 118 at a point forward of pivot pin 170 pulls the jaws open when the handles are released.

Floating wedge 174 has smooth bore **174*a* of a first diameter extending forwardly from its thick end for a portion of its length to a shoulder 174*b* at which the bore diameter is reduced and internally threaded for the rest of the length of the wedge. A shaft 182 secured to knob 142 and extending forwardly through an opening in end wall 140 and threadably engaging the internally threaded bore in wedge 174, is surrounded by a compression spring 184 disposed between the end wall and shoulder 174*b* which urges the wedge forwardly. The forward end of shaft 184 projects forwardly from the thin end of the wedge into contact with a rearwardly facing shoulder 166*a* formed on toggle link 166. As in the first embodiment, if desired, the forward end of shaft 182 may terminate short of the forward end of wedge 174, with the forward end of the floating wedge instead contacting shoulder 166*a*. Shoulder 166*a* has an arcuate shape and coacts with a cam-like action with the forward end of shaft 184 or floating wedge 174**, as the case may be.

The operation of this second embodiment being the same as that of the first embodiment detailed above, it is deemed unnecessary to repeat the description.

Although preferred embodiments of the invention have been described, it will now be evident to ones skilled in the art that certain modifications and changes may be made in the described locking tool without departing from the true spirit and scope of the invention. For example, the magnets secured in floater plate may have a shape other than circular, such as rectangular. Correspondingly, they may be replaced with a single rectangular centrally located magnetic element or eliminated by utilizing a floater plate composed of a ferromagnetic material which floater plate is magnetized. Also, the wedges may be dimensioned to accommodate a floater plate thicker than 1/16-inch, say, twice as thick, so as to increase the volume, and thus the pole strength of the magnets sufficiently to allow the use of less expensive alnico or ceramic magnets. Furthermore, the desired attraction of the wedges to the floater plate may be achieved by replacing the magnets in the floater plate with a magnet embedded in one or both of the wedges, preferably near the thick ends thereof. Accordingly, the scope of the invention should be determined with reference to the appended claims and not by the examples which have been disclosed herein.

What is claimed is:

1. A self-adjusting locking tool comprising, in combination:

an elongated first handle provided at a forward end with a stationary jaw and at a rearward end with a housing, wherein said housing has upper and lower surfaces parallel both to each other and to a long axis of said first handle and a rear wall;

a movable jaw pivotally connected to said forward end of said first handle and operable to coact with said stationary jaw;

an elongated second handle pivotally secured at one end to said movable jaw with the other end thereof extending rearwardly;

a toggle link pivotally secured on one end to said second handle with the other end thereof extending rearwardly toward said housing, wherein said toggle link has a rearwardly facing shoulder formed thereon at a location forward of its said other end;

a hinged wedge having a thick end and a thin end slidably disposed in said housing and pivotally connected at its thick end to said other end of said toggle link;

a floating wedge having a thick end and a thin end slidably disposed in said housing and separated from said hinged wedge by a floater plate, said wedges being arranged with the thin end of said floating wedge and the thick end of said hinged wedge facing toward said jaws;

means for magnetically attracting said hinged and floating wedges into contact with said floater plate with sufficient force to wipe away any oil that may be present on mating surfaces of said floater plate and wedges while still allowing said floater plate to slide relative to said wedges;

means positioned in said wrench for resiliently urging said floating wedge forwardly toward said jaws; and means on the thin end of said floating wedge for engaging the rearwardly facing shoulder on said toggle link to force said floating wedge rearwardly as the rearward end of said toggle link moves rearwardly upon movement of said second handle toward said first handle.

2. The tool of claim 1 wherein said floater plate is a steel plate having parallel planar upper and lower surfaces and wherein the means for magnetically attracting said hinged and floating wedges into contact with said floater plate comprises a planar magnet of selected size and magnetic strength of the same thickness as said floater plate secured in an opening formed in said floater plate.

3. The tool of claim 2 wherein said magnet is circular in shape and is adhesively secured in a circular opening formed in said floater plate.

4. The tool of claim 3 wherein a pair of circular-shaped magnets are secured with epoxy in respective circular openings formed in said floater plate, and wherein said magnets are made from a rare earth element exhibiting a strong magnetic pole strength.

5. The tool of claim 1 wherein said floater plate is composed of a ferromagnetic material and the means for magnetically attracting said hinged and floating wedges into contact with said floater plate comprises a magnetized floater plate.

6. The tool of claim 1 wherein said stationary jaw has a laminated construction comprising a plurality of laminae including at least one inner lamina secured between oppositely disposed outer laminae composed of steel.

7. The tool of claim 1 wherein said movable jaw has a laminated construction comprising a plurality of laminae including at least one inner lamina secured between oppositely disposed outer laminae composed of steel.

8. The tool of claim 1 wherein each of said stationary jaw and movable jaw has a laminated construction comprising a plurality of laminae, including at least one inner lamina secured between oppositely disposed outer laminae composed of steel.

9. The tool of claim 1 wherein said means for resiliently urging said floating wedge forwardly comprises a shaft extending through an opening formed in the rear wall of said housing and threadably engaging said floating wedge, and a compression spring surrounding said shaft and disposed between said housing rear wall and said floating wedge.

10. The tool of claim 1 wherein said toggle link has an adjustable stop located rearwardly of said one end and facing said second in a position to engage said second handle when said jaws are closed for limiting the force required to open the jaws.

11. A self-adjusting locking tool comprising, in combination:

an elongated first handle provided at a forward end with a stationary jaw and at a rearward end with a housing, wherein said housing has upper and lower surfaces parallel both to each other and to a long axis of said elongated handle and a rear wall;

a movable jaw pivotally connected to said forward end of said first handle and operable to coact with said stationary jaw;

an elongated second handle pivotally secured on one end to said movable jaw with the other end thereof extending rearwardly;

a toggle link pivotally secured on one end to said second handle with the other end thereof extending rearwardly toward said housing, wherein said toggle link has a rearwardly facing shoulder formed thereon at a location forward of said other end thereof;

a hinged wedge having a thick end and a thin end slidably disposed in said housing and pivotally connected at its thick end to said other end of said toggle link;

a floating wedge having a thick end and a thin end slidably disposed in said housing and separated from said hinged wedge by a floater plate, said wedges being arranged with the thin end of said floating wedge and the thick end of said hinged wedge facing toward said jaws;

a shaft extending through the rear wall of said housing and threadably engaging said floating wedge, and a compression spring surrounding said shaft and disposed between said housing rear wall and said floating wedge for resiliently urging said floating wedge forwardly toward said jaws; and means on the thin end of said floating wedge for engaging the rearwardly facing shoulder on said toggle link to force said floating wedge rearwardly upon movement of said second handle toward said first handle.

12. The tool of claim 11 wherein said shaft includes a forward end which is secured to and protrudes forwardly of the thin end of said floating wedge, and said means for engaging the rearwardly facing shoulder on said toggle link comprises said forward end of said shaft.

13. The tool of claim 11 wherein said stationary jaw has a laminated construction comprising a plurality of laminae including at least one inner lamina secured between oppositely disposed outer laminae composed of steel.

14. The tool of claim 11 wherein said movable jaw has a laminated construction including at least one inner lamina secured between oppositely disposed outer laminae composed of steel.

15. The tool of claim 11 wherein each of said stationary jaw and movable jaw has a laminated construction comprising a plurality of laminae including at least one inner lamina secured between oppositely disposed outer laminae composed of steel.

16. A self-adjusting locking tool comprising, in combination:

an elongated first handle provided at a forward end with a stationary jaw and a rearward end with a housing, wherein said housing has upper and lower surfaces parallel both to each other and to a long axis of said elongated handle, said fixed jaw having a laminated construction which includes a plurality of laminae, at least one of said laminae being an inner lamina secured between oppositely disposed outer laminae composed of steel;

a movable jaw pivotally connected to said forward end of said first handle and operable to coact with said stationary jaw, said movable jaw having a laminated construction which includes a plurality of laminae, at least one of which is an inner lamina secured between oppositely disposed outer laminae composed of steel;

an elongated second handle pivotally secured on one end to said movable jaw with the other end thereof extending rearwardly;

a toggle link pivotally secured on one end to said second handle with the other end thereof extending rearwardly toward said housing, wherein said toggle link has a rearwardly facing shoulder thereon;

a hinged wedge having a thick end and a thin end slidably disposed in said housing and pivotally connected at its thick end to said other end of said toggle link;

a floating wedge having a thick end and a thin end slidably disposed in said housing and separated from said hinged wedge by a floater plate, said wedges being arranged with the thin end of said floating wedge and the thick end of said hinged wedge facing toward said jaws, said floater plate including means for magnetically attracting said hinged and floating wedges into contact with said floater plate with sufficient force to wipe away any oil that may be present on mating surfaces thereof while still allowing said floater plate to slide relative to said wedges;

a spring operatively associated with said floating wedge for forwardly urging said floating wedge toward said jaws; and means on the thin end of said floating wedge for engaging the rearwardly facing shoulder on said toggle link to force said floating wedge rearwardly as the rearward end of said toggle link moves rearwardly upon movement of said second handle toward said elongated handle.

* * * * *